US005971224A

United States Patent [19]

Garibaldi

[11] Patent Number: 5,971,224

[45] Date of Patent: Oct. 26, 1999

[54] PASTY OR CREAMY SUBSTANCE DISPENSER

[75] Inventor: Giuseppe Garibaldi, Milan, Italy

[73] Assignee: Capsol S.p.A. Stampaggio Resine Termoplastiche, Colgnago, Italy

[21] Appl. No.: 09/195,218

[22] Filed: Nov. 18, 1998

[30] Foreign Application Priority Data

Jan. 15, 1998 [IT] Italy ..... MI98A0060

[51] Int. Cl.[6] ..... B65D 37/00

[52] U.S. Cl. ..... 222/207; 222/387; 222/494

[58] Field of Search ..... 222/207, 212, 222/215, 386, 387, 383.1, 494

[56] References Cited

U.S. PATENT DOCUMENTS

| | | | |
|---|---|---|---|
| 4,830,229 | 5/1989 | Ball | 222/207 |
| 4,903,867 | 2/1990 | Mettenbrink | 222/494 |
| 5,377,880 | 1/1995 | Moretti | 222/387 |

*Primary Examiner*—Philippe Derakshani
*Attorney, Agent, or Firm*—Oblon, Spivak, McClelland, Maier & Neustadt, P.C.

[57] ABSTRACT

A pasty or creamy substance dispenser comprising a bottle having a cylindrical chamber for containing a substance to be dispensed, and an elastically deformable cap mounted on the bottle and defining a compression chamber for the substance with an elastically deformable wall formed integrally with the bottle, the cylindrical chamber of which is closed by a piston movable under sealed conditions.

3 Claims, 2 Drawing Sheets

PASTY OR CREAMY SUBSTANCE DISPENSER

A pasty or creamy substance dispenser comprising a bottle defining a cylindrical chamber, and an elastically deformable cap which with a wall of the bottle defines a compression chamber for the substance to be dispensed, the cylindrical chamber being closed by a piston sealedly movable within it. In the cap there is provided a discharge hole closable by an appendix which projects from the bottle and into the compression chamber, the substance being dispensed by manually deforming the cap, the substance then passing from the cylindrical chamber to the compression chamber through one or more apertures provided in the wall separating the two chambers, in correspondence with this aperture there being provided a non-return valve which enables the substance to pass only from the cylindrical chamber to the compression chamber but not vice versa.

When delivery of the substance ceases, the deformable cap returns elastically to its rest position to close the discharge hole and draw from the cylindrical chamber a quantity—equal to that just dispensed—of creamy substance which passes through the non-return valve to penetrate into the compression chamber. During this transfer of creamy substance between the two chambers of the dispenser, the effect of the external atmospheric pressure and the vacuum created in the two chambers of the dispenser causes the piston housed in the cylindrical chamber to sealedly move within the chamber itself, so decreasing its volume.

Dispensers of this type are described in the patents EP-A-0097972, EP-A-0013691, U.S. Pat. No. 4,402,431, EP-A-0363307, EP-A-0600286 and the corresponding U.S. Pat. No. 5,377,880.

Specifically, EP-A-0363307 describes a dispenser in which the creamy substance can be delivered through a hole provided in the deformable cap and positioned above the smooth end surface of an appendix which extends into the compression chamber, the cap portion totally surrounding said hole being pressed elastically against said smooth surface, with a very poor sealing effect and with part of the creamy substance remaining to fill the space bounded by the periphery of the hole in the cap and the underlying surface of the rigid appendix. The creamy substance passes from the cylindrical chamber to the compression chamber of the dispenser through apertures provided in a rigid wall on which a flat ring is superposed to as a non-return valve which freely floats above said apertures, and is unable to prevent the creamy substance returning from the compression chamber to the cylindrical chamber of the dispenser, the operability of which is hence seriously compromised.

The dispenser described in EP-A-0600286 and U.S. Pat. No. 5,377,880 differs from that of EP-A-0363307 in that that end of an appendix extending into the compression chamber from a rigid wall bounding one end of the cylindrical chamber of the dispenser penetrates into the hole in the deformable cap, to prevent any dispensed substance remaining within it and to ensure proper sealed closure of the hole when in the rest state. Moreover the non-return valve controlling the passage of the creamy substance from the cylindrical chamber to the compression chamber of the dispenser is no longer freely floating, but consists of a flexible disc having a central sleeve which is forced onto and retained on said appendix, the flexible disc being superposed on the apertures provided in the rigid wall which separates the two chambers of the dispenser, and being pressed by elasticity onto the surface of said rigid wall to seal against it and hence prevent the creamy substance returning to the cylindrical chamber when the dispenser is in the rest state.

The creamy substance dispensers described in the afore-discussed patents all have a structure comprising, as essential basic elements, an elongate bottle defining a cylindrical chamber in which the creamy substance is contained, a piston sealedly movable within the cylindrical chamber and closing one of its ends, and an elastically deformable cap mounted on the other end of the bottle and defining a compression chamber with a rigid wall which closes the other end of the cylindrical chamber, in said rigid wall there being provided apertures on which there is superposed (to act as a non-return valve) a floating or flexible disc housed in the compression chamber and embracing an appendix which extends from said rigid wall and of which the end closes the discharge hole provided in the deformable cap.

These dispensers hence comprise a minimum of four constituent elements, ie the bottle, the movable piston, the deformable cap and the floating or flexible ring acting as a non-return valve. Moreover the creamy substance is always dispensed therefrom by deforming a cap, the discharge hole of which has to be shifted from its rest position to release it from the end of the hole closure appendix which is rigid and is fixed relative to the bottle.

The main object of this invention is to provide a pasty or creamy substance dispenser which comprises only three basic components, hence being less costly and of easier assembly than similar known dispensers.

A further object is to provide a dispenser in which the discharge hole in the cap is opened during the dispensing operation by withdrawing the free end of the appendix acting as the hole shutter when in the rest state, without it being necessary to deform the cap in the vicinity of its discharge hole.

These and further objects are attained by a dispenser comprising an elongate bottle defining a cylindrical chamber fillable with a pasty or creamy substance and having a first end and a second end, a piston sealedly movable within said chamber and closing its first end, a profiled wall integral with said bottle and closing the second end of its chamber, at least one aperture provided in said profiled wall, a non-return valve provided in correspondence with said aperture to enable said substance to emerge from the cylindrical chamber, an elastically deformable cap mounted on said bottle in correspondence with said profiled wall and defining therewith a compression valve chamber for said substance, a hole provided in the cap for the exit of said substance from the compression chamber, and at least one closure element for said hole, which is closed when in the rest state and is opened by manual deformation of said cap, characterised in that said profiled wall is elastically deformable, a portion thereof forming at least one hollow appendix extending into said compression chamber, said aperture being provided in at least one of said hollow appendices, the end of one hollow appendix constituting said closure element for the hole in the deformable cap, said non-return valve comprising a flexible tab projecting from the cap and into the interior of the compression chamber to overlie said aperture and resting on and slidable along the surface of the appendix in which the aperture is provided, that end of the appendix facing the hole in the deformable cap being withdrawn from the hole when the cap is manually deformed with consequent elastic deformation of said profiled wall under the thrust of the substance present in the compression chamber.

The structure and characteristics of the dispenser of the invention will be more apparent from the ensuing description of a preferred embodiment thereof provided by way of non-limiting example with reference to the accompanying drawings, on which:

Figure 1:
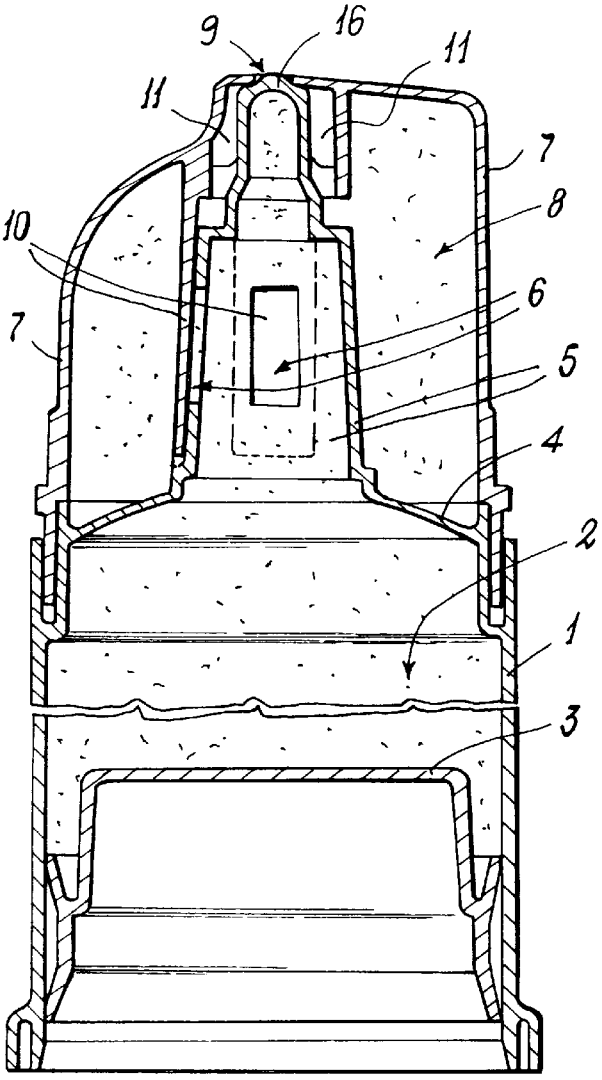
FIG. 1 is an axial section through the dispenser in the rest state.

The dispenser shown on the drawings comprises an elongate bottle 1 defining a cylindrical chamber 2 closed at one end by a piston 3 sealedly movable within the chamber 2, which is bounded at its other end by a profiled wall 4.

From the centre of the dome-shaped wall 4 there projects an elongate hollow appendix 5 in which apertures 6 are provided (only two of which can be seen in FIGS. 1 to 3, one in section and one in frontal view) and of which the free end 16 is closed and profiled.

Figure 2:
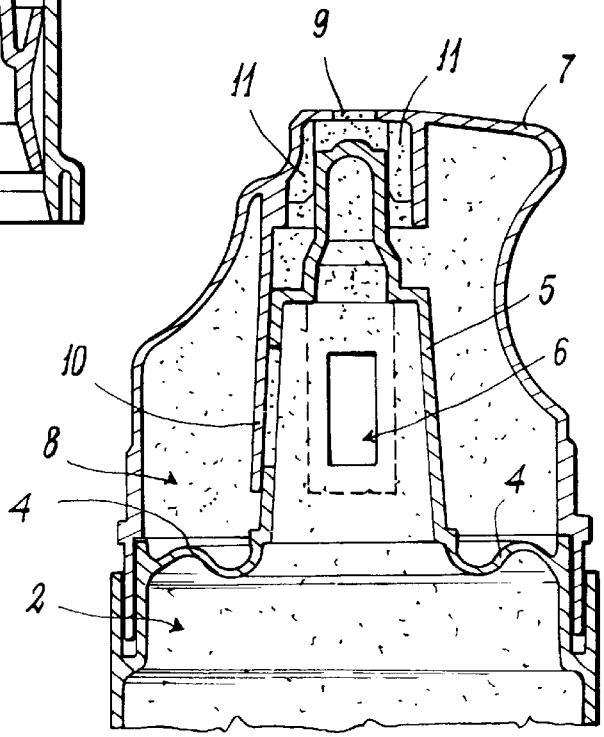
FIGS. 2 and 3 are similar to FIG. 1 but show the dispenser during its operation and during the subsequent intermediate stage of its return to its rest position respectively.

The bottle 1, the wall 4 and the appendix 5 are formed in one piece by moulding a plastic material of good elastic deformability, by virtue of which the wall 4 (which, as can be seen from the drawings, has a lesser thickness than the bottle 1 defining the cylindrical chamber 2 and than the appendix 5) can be made to flex elastically downwards (with respect to the drawings) and vice versa, between the rest position of FIG. 1 and the dispensing position of FIG. 2.

On the upper end of the bottle there is sealedly mounted an elastically deformable cap 7 which together with the wall 4 defines a compression chamber 8. In the top of the cap 7 there is provided a hole 9 into which, when the dispenser is in its rest state, the free end 16 of the appendix 5 is sealedly inserted to close it (FIG. 1).

From the drawings it can be seen that from the top of the cap 7 there project elongate flexible tabs 10 which overlie each of the apertures 6. These tabs rest on and can slide along the outer surface of the appendix 5 in the region in which the apertures 6 are provided (in FIGS. 1 to 3 one of the tabs 10 is shown in section, the profile of another being shown by dashed lines).

Finally it can be seen that fins 11 project from the cap 7 all around the hole 9, to rest on the outer surface of the upper end of the appendix 5 to maintain it centered about the hole 9.

It will be assumed that the dispenser is in the rest position of FIG. 1 and that the chambers 2 and 8 are full with a pasty or creamy substance, for example toothpaste. Under these conditions the free end 16 of the appendix 5 hermetically closes the hole 9 in the cap 7 to perfectly isolate the substance from the outside environment (this being particularly important if the substance is a pharmaceutical or cosmetic product).

Figure 4:
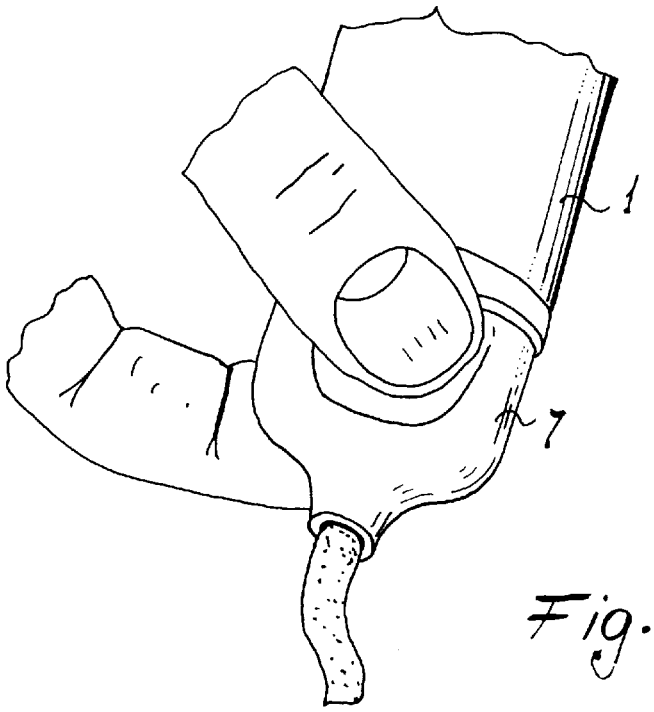
FIG. 4 is an external view of the dispenser during its use, with its cap pressed by two fingers of the user's hand.

If the dispenser is now overturned downwards (FIG. 4) and the cap 7 squeezed with two fingers (so deforming it) the creamy substance present in the chamber 8 is compressed. This compressed substance urges the tabs 10 against the surface of the appendix 5 to hence very effectively close the apertures 6 (FIG. 2) and cause the wall 4 to deform downwards, with consequent lowering of the appendix 5, the free end 16 of which withdraws from the hole 9 in the cap (FIG. 2) to enable the creamy substance to emerge from the hole 9 under the thrust of the pressurized substance enclosed in the chamber 8. It should be noted that during its traversing movement relative to the cap 7, the upper end of the appendix 5 is guided by the fins 11.

Figure 3:
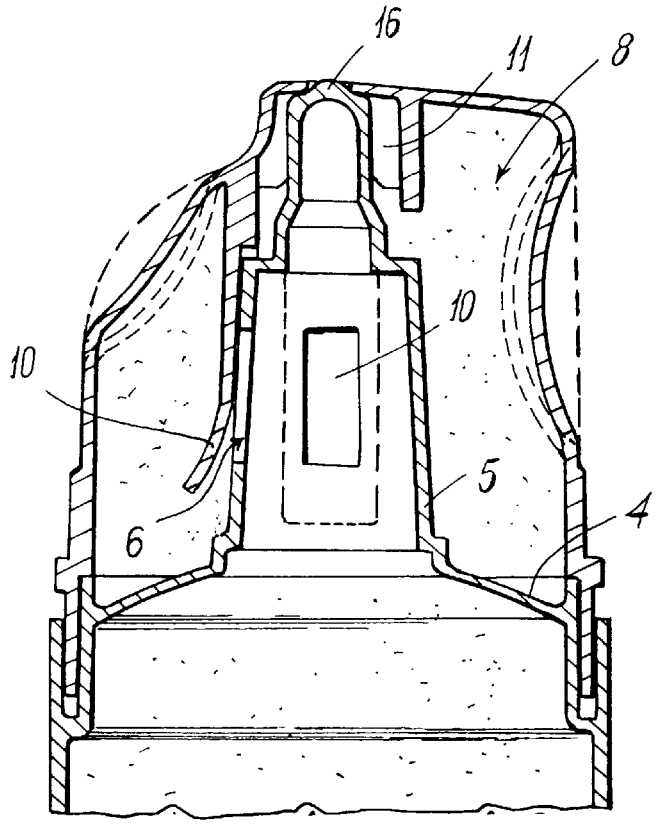

When the pressure exerted by the two fingers on the deformable cap 7 ceases, this tends to return elastically from its most compressed or deformed position (represented by a double dashed line on the cap in FIG. 3) to its rest position indicated by a single dashed line on the cap in FIG. 3, in which the cap itself is shown in an intermediate position between the aforesaid positions by full lines.

As soon as the pressure of the creamy substance within the chamber 8 falls sufficiently, the wall 4 returns elastically to its rest position (FIG. 3) and the end 16 of the appendix 5 hermetically seals the hole 9, the cap 7 being still partially deformed as shown by full lines in FIG. 3.

The cap continues to expand elastically to return to its rest position of FIG. 1, and during this further expansion it creates a vacuum in the chamber 8, with consequent upward movement into it of a part of the creamy substance contained in the chamber 2, which passes through the apertures 6 to deflect the tabs 10 towards the interior of the chamber 8, as shown in FIG. 3.

When the cap has returned to its rest position (FIG. 1), both the hole 9 and the apertures 6 have been closed as already stated.

It should be noted that the described dispenser comprises only three constituent parts of simple construction and assembly, and is hence very economical.

The two chambers of the dispenser are filled with the creamy substance in the same manner as similar dispensers of known type, described in the aforestated patents.

The drawings show a dispenser with only one appendix 5 projecting from its deformable wall 4. It should however be noted that two (or more) appendices can project from this wall into the compression chamber, of which only one closes the hole in the deformable cap, and that the communication apertures between the two dispenser chambers can be provided in both or in only one of these appendices.

I claim:

1. A pasty or creamy substance dispenser comprising an elongate bottle defining a cylindrical chamber fillable with a pasty or creamy substance and having a first end and a second end, a piston sealedly movable within said chamber and closing its first end, a profiled wall integral with said bottle and closing the second end of its chamber, at least one aperture provided in said profiled wall, a non-return valve provided in correspondence with said aperture to enable said substance to emerge from the cylindrical chamber, an elastically deformable cap mounted on said bottle in correspondence with said profiled wall and defining therewith a compression valve chamber for said substance, a hole provided in the cap for the exit of said substance from the compression chamber, and at least one closure element for said hole, which is closed when in the rest state and is opened by manual deformation of said cap, characterised in that said profiled wall is elastically deformable, a portion thereof forming at least one hollow appendix extending into said compression chamber, said aperture being provided in at least one of said hollow appendices, the end of one hollow appendix constituting said closure element for the hole in the deformable cap, said non-return valve comprising a flexible tab projecting from the cap and into the interior of the compression chamber to overlie said aperture and resting on and slidable along the surface of the appendix in which the aperture is provided, that end of the appendix facing the hole in the deformable cap being withdrawn from the hole when the cap is manually deformed with consequent elastic deformation of said profiled wall under the thrust of the substance present in the compression chamber.

2. A dispenser as claimed in claim 1, characterised in that said profiled wall comprises a single hollow appendix.

3. A dispenser as claimed in claim 1, characterised in that said profiled wall comprises at least two hollow appendices, in at least one of which said aperture is provided, the end of one of said appendices forming said closure element for the hole in the deformable cap.

* * * * *